US008020492B1

(12) United States Patent
Kapeles

(10) Patent No.: US 8,020,492 B1
(45) Date of Patent: Sep. 20, 2011

(54) LOW LETHALITY IMPACT PAYLOAD DELIVERY SUB-MUNITIONS AND METHODS OF MANUFACTURE

(75) Inventor: John A. Kapeles, Casper, WY (US)

(73) Assignee: Safariland, LLC, Jacksonville, FL (US)

( * ) Notice: Subject to any disclaimer, the term of this patent is extended or adjusted under 35 U.S.C. 154(b) by 331 days.

(21) Appl. No.: 12/181,432

(22) Filed: Jul. 29, 2008

Related U.S. Application Data

(60) Provisional application No. 60/953,783, filed on Aug. 3, 2007.

(51) Int. Cl.
*F42B 12/40* (2006.01)
*F42B 12/46* (2006.01)

(52) U.S. Cl. ..... 102/502; 102/512; 102/513

(58) Field of Classification Search ..... 102/502, 102/501, 512, 513
See application file for complete search history.

(56) References Cited

U.S. PATENT DOCUMENTS

| | | | | |
|---|---|---|---|---|
| 3,952,662 | A | 4/1976 | Greenlees | |
| 4,823,702 | A * | 4/1989 | Woolsey | 102/502 |
| 5,221,809 | A | 6/1993 | Cuadros | |
| 5,450,795 | A | 9/1995 | Adelman | |
| 6,202,562 | B1 * | 3/2001 | Brunn et al. | 102/502 |
| 6,283,037 | B1 * | 9/2001 | Sclafani | 102/502 |
| 6,302,028 | B1 * | 10/2001 | Guillot-Ulmann et al. | 102/502 |
| 6,374,742 | B1 * | 4/2002 | Brunn et al. | 102/502 |
| 6,655,294 | B1 * | 12/2003 | Kerr | 102/502 |
| 6,752,086 | B2 | 6/2004 | Kravel et al. | |
| 6,755,133 | B1 * | 6/2004 | Brunn et al. | 102/502 |
| 6,862,995 | B2 | 3/2005 | Kerr | |
| 7,089,864 | B2 | 8/2006 | Brunn et al. | |
| 7,278,357 | B2 | 10/2007 | Keith et al. | |
| 7,331,293 | B2 | 2/2008 | Saxby | |
| 7,444,941 | B1 * | 11/2008 | Brunn et al. | 102/502 |
| 7,461,597 | B2 * | 12/2008 | Brunn | 102/463 |
| 2005/0188886 | A1 | 9/2005 | Vasel et al. | |
| 2006/0260500 | A1 | 11/2006 | Engel et al. | |

FOREIGN PATENT DOCUMENTS

JP 2000167095 A * 6/2000

OTHER PUBLICATIONS

Defense Technology Corporation of America 2001 Specification Manual on Drag Stabilized 12-Gauge Bean Bag (3 pages) (enclosed).

* cited by examiner

*Primary Examiner* — James Bergin
(74) *Attorney, Agent, or Firm* — Renner, Otto, Boisselle & Sklar, LLP

(57) ABSTRACT

A low lethality impact sub-munition and method of making same, the sub-munition including a closed compartment containing a concentration of payload material in close proximity to the forward end of the compartment and a charge of ballast material rearward of the payload material. At least the forward end of the compartment is sufficiently porous that at least some of the payload material will disperse through the forward end but not the ballast material upon impact of the sub-munition with a target.

18 Claims, 2 Drawing Sheets

LOW LETHALITY IMPACT PAYLOAD DELIVERY SUB-MUNITIONS AND METHODS OF MANUFACTURE

CROSS-REFERENCE TO RELATED APPLICATIONS

This application claims the benefit of U.S. Provisional Application No. 60/953,783, filed Aug. 3, 2007.

FIELD OF THE INVENTION

This invention relates generally to the field of low lethality impact sub-munitions which impart blunt energy to redirect, control and/or incapacitate aggressive human targets, and specifically to such sub-munitions that are also designed to deliver a payload to a target and to methods of manufacturing such sub-munitions.

BACKGROUND OF THE INVENTION

Low lethality impact munitions are available in a number of configurations and calibers. These munitions may be designed for use against multiple subjects (area effect), or a single subject (point control). Area effect munitions are comprised of loaded munition platforms which contain multiple sub-munitions that may be discharged into a group of two or more subjects (i.e., human targets). Point control munitions are normally loaded with a single sub-munition. These latter munitions are typically designed to be more accurate and allow for a more precise single target acquisition and deployment.

The design of low lethality impact sub-munitions ranges from basic wooden batons and rubber balls to advanced drag and spin stabilized designs. Accuracy of the sub-munitions is dependent on their caliber and intended use. Advanced large caliber point control type sub-munitions rely on spin stabilization for increased accuracy. These munitions are designed to interface with rifling features in the large caliber launcher barrels to cause the sub-munitions to spin up when discharged. While this type of stabilization yields a round with exceptional accuracy and broader range performance, the large caliber launchers are not as common as smooth bore launchers which do not have features to induce the spinning of sub-munitions.

Smooth bore low lethality impact munitions can be broken into two different types, stabilized and non-stabilized. Non-stabilized munitions do not utilize any design features to aid in their accuracy or performance. These types of munitions are mainly used in area effect deployments. Stabilized smooth bore munitions typically are designed to use either fin or drag stabilization. Fin stabilized sub-munitions are designed with fin features that induce spinning and/or are intended to stabilize their flight path. Drag stabilized munitions are designed with features that trail behind the sub-munition main body during flight to produce a drag effect which in turn stabilizes the sub-munitions.

In the case of such drag stabilized or "bean bag" sub-munitions made of a suitable fabric material filled with shot or pellets, it is generally known to coat the fabric material with a payload material such as irritant or inflammatory chemicals or marking agents or dyes by shaking the sub-munitions in a bag containing the payload material or other similar means to form a dispersion of the payload material on the fabric so that some of the payload material is transferred to the target on impact of the sub-munitions therewith.

There are several problems in using this method to incorporate a payload into drag stabilized or bean bag sub-munitions. First, coating the entire sub-munitions with payload material is not a very efficient way to deliver the payload material to the target because much of the payload material on the surface of the sub-munitions is not transferred to the target. Also some of the payload material is lost during firing of the munitions and flight of the sub-munitions to the target. Thus more payload material must be used to achieve an acceptable delivery amount to, the target.

SUMMARY OF THE INVENTION

The present invention relates to low lethality impact sub-munitions of the drag stabilized or bean bag type and methods of manufacture that incorporate a payload material in the sub-munitions at a location to maximize the efficiency of delivery of the payload material to a target while minimizing the need for excess payload or waste. Such payload material may include powders, liquids or gels of irritant or inflammatory chemicals and/or marking agents or dyes and the like.

The payload material is located in the forward end of the main body of the sub-munitions to more efficiently transfer the payload material to the target upon impact of the sub-munitions with the target.

The payload material is loaded into the main body of the sub-munitions prior to loading the shot or pellets into the main body, and prior to closure of the main body. Moreover, the payload material may be loaded into the main body in a powder-like form, or be encapsulated or compacted into a separate unit such as a pellet for ease of handling and loading of the payload material into the main body.

These and other advantages, features and aspects of the present invention will become apparent as the following description proceeds.

DETAILED DESCRIPTION OF THE INVENTION

The present invention will be described with respect to its application to a drag stabilized low lethality impact payload delivery sub-munition. However, the same concepts and methods are also applicable to other types of low lethality impact sub-munitions incorporating a payload.

Figure 1:
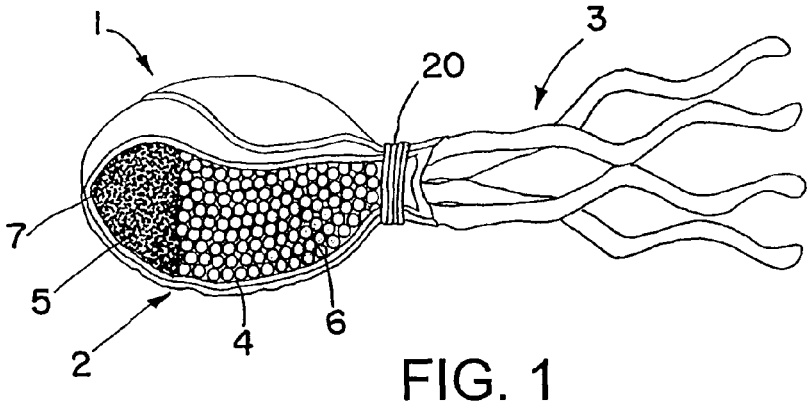
FIG. 1 is a schematic perspective view, partly in section, of one form of low lethality impact payload delivery sub-munition of the present invention.

Referring now in detail to the drawings, wherein the same reference numbers are used to designate like parts, and initially to FIG. 1, there is shown one form of low lethality impact payload delivery sub-munition 1 of the present invention which includes two main sections, a main body 2 and trailing features 3 which deploy during flight to produce a drag effect which in turn helps to stabilize the sub-munition during flight.

The main body 2 is comprised of a closed pliable compartment 4 that contains a suitable payload material 5 such as an irritant or inflammatory chemicals or marking agents or dyes and the like that is transferred to the target on impact, and a suitable quantity and type of ballast 6 to impart low lethality blunt energy to the target also on impact. Typically the ballast material is shot or pellets, but other ballast materials may also be used including for example relatively heavy powders or gels or encapsulated liquids or a single piece of ballast material such as a densified rubber that impart the required blunt energy to the target on impact.

Payload material 5 is located in the forward end 7 of the main body compartment 4 to more efficiently transfer the payload material to the target through the material of the main body compartment which should be sufficiently strong that it will not break apart upon impact and sufficiently porous that the payload material will at least disperse through the forward end of the compartment upon impact to at least partially coat the target with the payload material. For example, the compartment may be made of a suitable semi-permeable material such as a fabric material or a rubber-like material that has a forward end that is scored or slotted to allow the payload material to disperse through the material but has sufficient integrity to retain the ballast material within the compartment upon impact of the sub-munition with a target.

Figure 6:
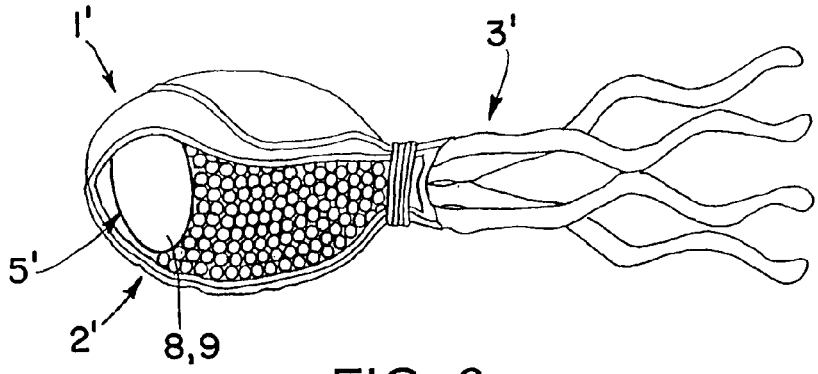
FIG. 6 is a schematic perspective view, partly in section, of another form of low lethality impact payload delivery sub-munition of the present invention.

In the embodiment shown in FIG. 1, the payload material 5 that is contained in the main body compartment 4 is in the form of a powder-like material. However, the payload material may also be in the form of a liquid or gel that is encapsulated in a thin membrane 8 or compacted with or without the aid of a binder or coating to form a pellet 9 as schematically shown in FIG. 6. Also the payload material may be incorporated into a secondary media such as a sponge which can then be cut up and loaded into the main body compartment. Otherwise, the sub-munition 1' shown in FIG. 6 is substantially the same as that shown in FIG. 1 and accordingly the same reference numerals followed by a prime symbol are used to designate the same or similar parts.

The material(s) used to construct the trailing features 3 may but need not be of the same type used in the main body 2. For example, the trailing features 3 may be of single or multiple strands or tubular webbing design, and may be secured to the main body 2 as by sewing, stapling, gluing or similar means or be an extension of the material of the main body as shown in FIG. 1. The sub-munition 1 is loaded into a munition or shell case (not shown), and may be held in place by any number of different closure methods including crimping, rolling and interference locking. When loaded into a shell case, the sub-munition takes on the general shape of the internal shape of the shell cavity. After firing and during flight, the sub-munition assumes various shapes depending on the opposing propulsive and resistive aerodynamic forces, as well as the removal of the confinement provided by the shell side walls.

Figure 2:
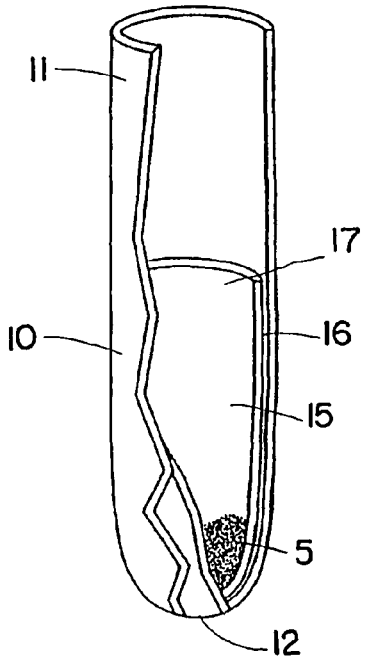
FIGS. 2-5 are schematic perspective views showing various steps in the method of manufacture of low lethality impact payload delivery sub-munitions of the present invention.

FIGS. 2-5 schematically illustrate one method of making the sub-munition 1 shown in FIG. 1. Referring initially to FIG. 2, such method involves twisting and/or tying a suitable length of pliable tubing 10 in a desired location intermediate its ends and pulling the longer end 11 back on itself up to the twist or tie 12 to form two inner compartments 15 and 16 each closed at their inner ends and open at their outer ends 11 and 17 as shown in FIG. 2. The pliable material is then placed with the closed ends facing down and the open ends facing upward to facilitate placement of a predetermined quantity of the payload material 5 into the innermost compartment 15 through both open ends and into contact with the pliable material at the inner or forward end of the innermost compartment. A suitable measuring device (not shown) may be used to collect a predetermined quantity of the payload material prior to transferring the payload material into the innermost compartment.

Figure 3:
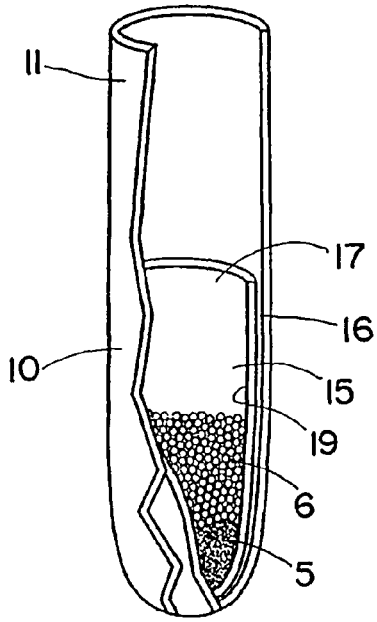
Figure 4:
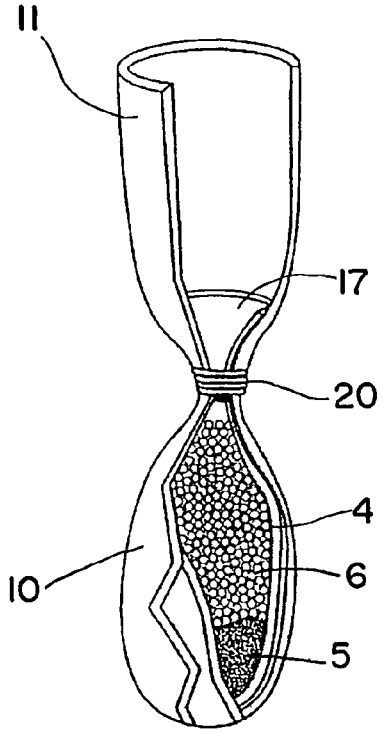

A predetermined quantity of ballast 6 is then inserted through the open ends 11 and 17 of both compartments into the innermost compartment 15, coming into contact with the payload material 5 located in the forward end of the innermost compartment and the side walls 19 of the innermost compartment as shown in FIG. 3. Both compartments are then closed as by a suitable constriction 20 such as tying, stitching, stapling, gluing or other suitable means the layers of both compartments together outward of the ballast 6 to form the closed main body compartment 4 that contains the payload material 5 and ballast 6 as shown in FIG. 4.

Figure 5:
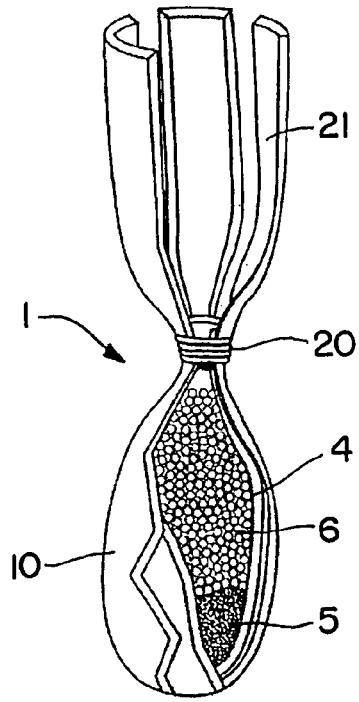

Thereafter the open end 11 of the material 10 may be turned inside out to expose the other open end 17 so the other open end 17 extending beyond the closure 20 can be cut off in close proximity to the closure as shown in FIG. 5. Next the end 11 of the material 10 may be pulled up over a cutting fixture or the like (not shown) and cut into a plurality of strands 21 as shown in FIG. 5 to form the trailing feature 3.

The low lethality impact payload delivery sub-munition 1' shown in FIG. 6 may be made substantially the same way as the sub-munition shown in FIG. 1 except that a predetermined quantity of the payload material 5 is first encapsulated or compacted to form a single unit 8, 9 containing the entire measured quantity of payload material before placing the payload material in the innermost compartment at the forward end thereof in contact with the fabric material in the manner previously described.

Specific methods of encapsulation may include placing the payload material in a thin membrane, compacting the material in a press with or without the aid of a binder or coating to form a pellet, or incorporating the payload material into a secondary media such as a sponge which can then be cut up and loaded into the innermost compartment through the open ends of both compartments.

The low lethality impact payload delivery sub-munitions of the present invention and methods of manufacture have the advantage over previous known low lethality impact payload delivery sub-munitions in which the entire sub-munitions are coated with the payload material in that the pliable material of the sub-munitions of the present invention does not become saturated or filled with the payload material, and only minimal dispersion of the payload material into the pliable material and/or ballast occurs during the manufacturing process. Moreover, virtually all of the payload material is located in the forward end of the sub-munition main body to more efficiently transfer the payload material through the pliable material of the main body which is sufficiently porous to permit a substantial amount of the payload material to pass through the material of the main body to the target but not the ballast material upon impact of the sub-munitions with the target.

Although the invention has been shown and described with respect to certain embodiments, it is obvious that equivalent alterations and modifications will occur to others skilled in the art upon the reading and understanding of the specification. In particular, with regard to the various functions performed by the above-described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the function of the herein illustrated exemplary embodiments of the invention. In addition, while a particular feature of the invention may have been disclosed with respect to only one embodiment, such feature may be combined with one or more other features, as may be desired and advantageous for any given or particular application.

What is claimed is:

1. A low lethality impact sub-munition comprising a pliable main body having a closed compartment including a forward end and a rear end and trailing features that deploy during flight to provide a drag effect on the sub-munition, a concentration of payload material within the compartment in close proximity to the forward end, and a charge of ballast material in the compartment rearward of the payload material, at least the forward end of the compartment being sufficiently porous to permit at least some of the payload material to disperse through the forward end but not the ballast material upon impact of the sub-munition with a target.

2. The sub-munition of claim 1 wherein the payload material is a powder-like material.

3. The sub-munition of claim 1 wherein the payload material is encapsulated.

4. The sub-munition of claim 3 wherein the payload material is an encapsulated liquid or gel.

5. The sub-munition of claim 1 wherein the payload material is contained within a compacted pellet.

6. The sub-munition of claim 1 wherein the payload material is incorporated into a secondary media that is cut up.

7. The sub-munition of claim 1 wherein the payload material comprises one or more of an irritant, inflammatory chemical, marking agent and dye.

8. The sub-munition of claim 1 wherein the compartment is made of a semi-permeable fabric material.

9. The sub-munition of claim 1 wherein the compartment is made of a rubber-like material that is scored or slotted at the forward end to allow at least some of the payload material to disperse through the front end upon impact of the sub-munition with a target.

10. The sub-munition of claim 1 wherein the trailing features are secured to the main body.

11. The sub-munition of claim 1 wherein the trailing features are an extension of the main body.

12. The sub-munition of claim 1 wherein the ballast material comprises shot or pellets.

13. The sub-munition of claim 1 wherein the ballast material comprises one or more of shots, pellets, powders, gels, and encapsulated liquids.

14. A method of making a low lethality impact sub-munition comprising providing a pliable main body compartment having a closed forward end and a rear open end and trailing features that deploy during flight to produce a drag effect on the sub-munition, loading a quantity of payload material into the compartment through the rear open end, locating the payload material in close proximity to the closed forward end, then loading a charge of ballast material into the compartment through the rear open end, and closing the rear open end of the compartment, at least the forward end of the compartment being sufficiently porous to permit at least some of the payload material to disperse through the forward end but not the ballast material upon impact of the sub-munition with the target.

15. The method of claim 14 wherein the payload material is a powder-like material.

16. The method of claim 14 wherein the payload material is encapsulated or compacted prior to loading the payload material into the compartment.

17. The method of claim 14 wherein the trailing features are secured to the main body.

18. The method of claim 14 wherein the trailing features are an extension of the main body.

* * * * *